United States Patent [19]

Paredes

[11] 4,438,535

[45] * Mar. 27, 1984

[54] SEAT AND COVER ASSEMBLY FOR A TOILET BOWL

[76] Inventor: Candelario Paredes, 6608 Briarhaven Dr., Dallas, Tex. 75240

[ * ] Notice: The portion of the term of this patent subsequent to Aug. 3, 1999 has been disclaimed.

[21] Appl. No.: 377,805

[22] Filed: May 13, 1982

Related U.S. Application Data

[63] Continuation of Ser. No. 190,374, Sep. 24, 1980, Pat. No. 4,342,124.

[51] Int. Cl.[3] ..... A47K 13/00

[52] U.S. Cl. ..... 4/234; 4/236; 4/240

[58] Field of Search ..... 4/234, 236, 237, 240, 4/248, 251

[56] References Cited

U.S. PATENT DOCUMENTS 4,342,124 8/1982 Paredes ..... 4/234

*Primary Examiner*—Houston S. Bell, Jr.

*Attorney, Agent, or Firm*—Warren B. Kice

[57] ABSTRACT

A seat and cover assembly for a toilet bowl including a seat member and a cover member pivotally mounted to a mounting block for movement relative to the bowl between an upright position and a lowered position. Springs are provided for biasing the seat member and the cover member into an abutting relationship in both the upright and lower positions of the members, and a magnetic latch assembly quick-releasably secures the cover member in its upright position.

9 Claims, 6 Drawing Figures

SEAT AND COVER ASSEMBLY FOR A TOILET BOWL

This is a continuation of application Ser. No. 190,374 filed 9/24/80, now U.S. Pat. No. 4,342,124.

BACKGROUND OF THE INVENTION

This invention relates to a seat and cover assembly for a toilet bowl and, more particularly, to such an assembly that insures that the seat member is kept clean during all positions of it and the cover member.

It has long been recognized, especially in industrial and commercial applications, to provide a seat for a toilet bowl with a biasing means, such as a spring, to automatically raise the seat during periods of non-use to prevent soiling of the seat when the toilet is used by a male in the standing position. However, in domestic environments in which a cover is almost universally provided for the toilet seat, practical problems arise in connection with this type of arrangement. For example, it is impossible to place the seat and the cover in their lowered positions during periods of non-use, which is a significant disadvantage from an aesthetic standpoint. Also, if the seat is biased to its upright position with a spring force sufficient to also bias the cover upwardly, it becomes difficult to separate the seat from the cover when it is desired to use the seat in its lowered position. In other arrangements utilizing a springloaded seat, the bias is set only to bias the seat with a sufficient force so that it will stay in its upright position notwithstanding the fact that the cover may be covered with a relatively thick fabric material. However, in these arrangements the bias is insufficient to move the seat upwardly when the seat is in its lowered position.

SUMMARY OF THE INVENTION

It is therefore an object of the present invention to provide a seat and cover assembly for a toilet bowl in which the seat, after being used in its lowered position, will be biased to its upright position.

It is a further object of the present invention to provide an assembly of the above type in which the seat and cover are biased together in both their upright and lowered positions.

It is still a further object of the present invention to provide an assembly of the above type in which the cover is latched relative to the toilet bowl in its upright position to facilitate separation of the seat and cover.

It is a still further object of the present invention to provide an assembly of the above type in which the seat and the cover can be placed in their normal lowered position during periods of non-use.

Toward the fulfillment of these and other objects, the seat assembly of the present invention includes a seat member and a cover member pivotally mounted relative to the toilet bowl for movement between an upright position and a lowered position. Spring means are provided for biasing the seat member and the cover member into an abutting relationship in all positions of the two members and means are provided for quick-releasably securing the cover member in its upright position.

DESCRIPTION OF THE PREFERRED EMBODIMENTS

Figure 1:
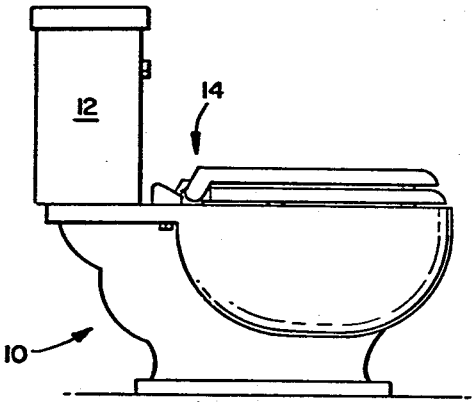
FIG. 1 is a front elevational view of a toilet bowl. arrangement incorporating the seat and cover assembly of the present invention and showing the latter assembly in its closed position.
Figure 2:
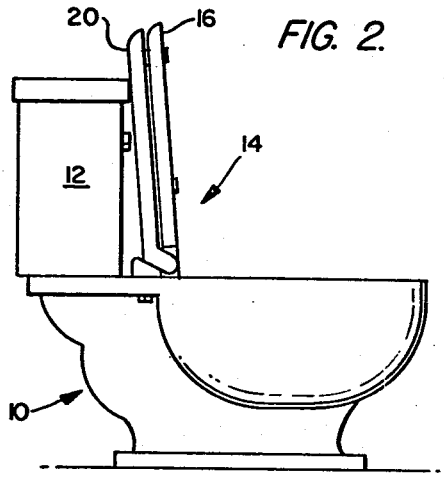
FIG. 2 is a view similar to FIG. 1 but depicting the seat and cover assembly of the present invention in its upright position.

Referring specifically to FIG. 1 of the drawings, the reference numeral 10 refers in general to a toilet bowl of a conventional design having a water reservoir 12 mounted thereon. The seat and cover assembly of the present invention is shown in general by the reference numeral 14 and is affixed to an upper surface of the toilet bowl 10 in a manner to be described later, and is movable between the lowered inoperative position shown in FIG. 1, the upright position for use by a male in the standing position shown in FIG. 2, and an operative position for use in the sitting position shown in FIG. 3.

Figure 4:
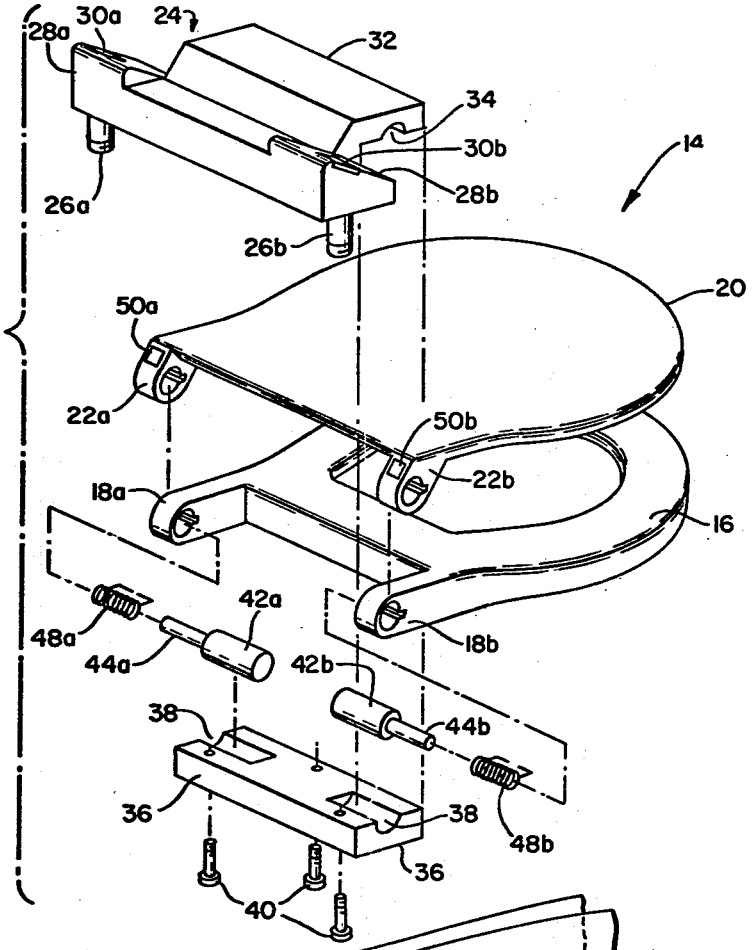
FIG. 4 is an enlarged, perspective, exploded view of the seat and cover assembly of the present invention.

Referring specifically to FIG. 4, which depicts the details of the seat and cover assembly of the present invention, the reference numeral 16 refers to a seat member of a general annular configuration having two mounting flanges 18*a* and 18*b* formed integrally with the rear portion thereof. A cover member 20 ias provided which extends over the seat member 16 in the lowered, or inoperative, position of the assembly and has two mounting flanges 22*a* and 22*b* extending integrally from its rear portion.

A mounting fixture 24 is provided which includes a pair of mounting posts 26 extending from the lower surface thereof which extend through corresponding standard openings formed in the toilet bowl 10 for fastening the fixture relative to the bowl in a conventional manner. The fixture 24 is shaped in a manner to define a pair of ramps 28*a* and 28*b* which are appropriately recessed to receive a pair of magnets 30*a* and 30*b*, respectively for reasons to be described in detail later. The fixture 24 also includes a forward extension block 32 which has a pair of semi-circular grooves 34 formed therein for reasons to be described in detail later. The extension block 32 cooperates with a separate, similarly shaped, block 36 also having two semi-circular grooves 38 formed therein which, together with the grooves 34, define two circular bores. The block 36 is mounted underneath the extension block 32 by a plurality of threaded bolts 40 which engage with appropriately formed threaded inserts (not shown) formed in the extension block 32.

Figure 5:
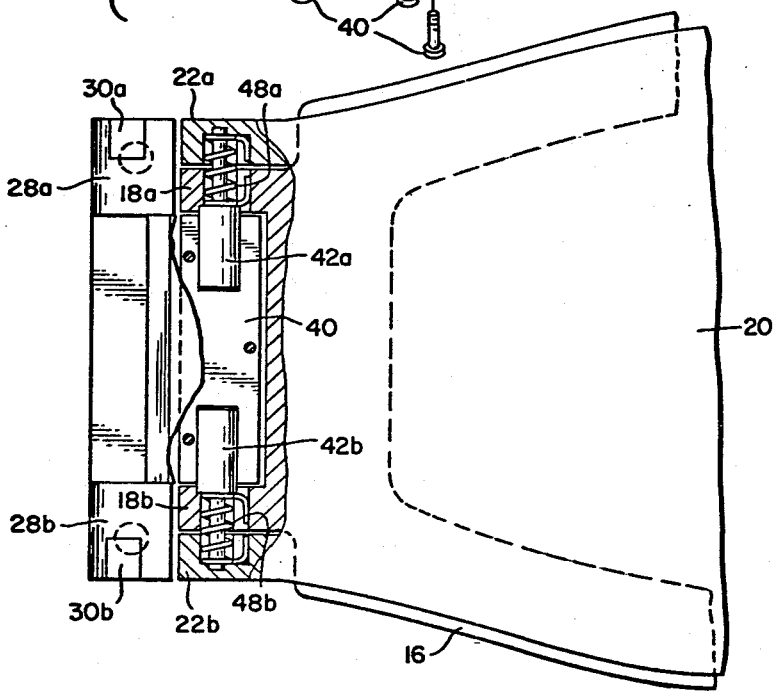
FIG. 5 is an enlarged top plan view, partially in section, of the seat and cover assembly of FIG. 4.

A pair of hinge pins 42*a* and 42*b* are provided which extend within the bores formed by the grooves 34 and 38. The hinge pins 42*a* and 42*b* have extensions 44*a* and 44*b*, respectively, of a slightly smaller diameter which project from the later grooves and receive torsion springs 48*a* and 48*b*, respectively. As better shown in FIG. 5, the mounting flanges 18*a* and 18*b* of the seat member 16b have circular openings formed therein which respectively align with similarly formed circular openings formed in the mounting flanges 22*a* and 22*b* of the cover member 20 which together receive the extensions 44*a* and 44*b*. The torsion springs 48*a* and 48*b* extend around their respective extensions 44*a* and 44*b* and include bent free end portions which engage in corresponding notches formed in the flanges 18*a*, 18*b*, 22*a* and 22*b*, and extending coextensive with the respective openings formed in the flanges. As a result, the springs 48*a* and 48*b* apply an oppositely-directed torque to continuously bias the seat member 16 and the cover member 20 together in all positions of the members.

Figure 6:
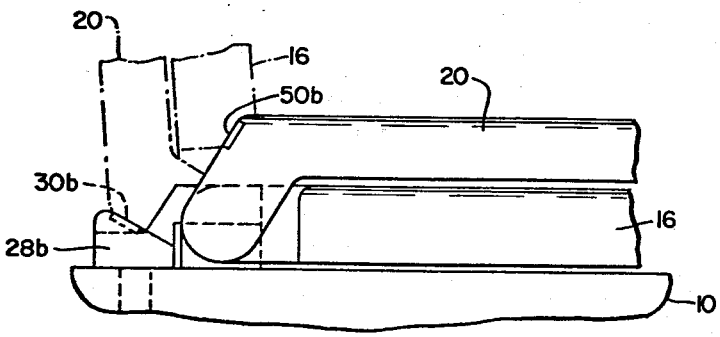
FIG. 6 is an enlarged, partial, front-elevational view of a portion of the seat and cover assembly of FIG. 4.

As shown in FIGS. 4 and 6, a pair of magnetic keepers 50*a* and 50*b* are formed in the back surface of the flanges 22*a* and 22*b* of the cover member 20 which magnetically engage with the magnets 30*a* and 30*b* formed on the ramps 28*a* and 28*b*, respectively of the fixture 24. This magnetic attraction between the magnets 30*a* and 30*b* and the keepers 50*a* and 50*b*, respectively, is such that the cover member 20 is latched in its upright position, but is easily unlatched when the cover member is moved toward its closed, or horizontal, position.

In view of the foregoing, it can be appreciated that the torsion springs 48*a* and 48*b* constantly urge the seat member 16 and the cover member 20 together in an abutting relationship in all positions of the two members. Also, the magnets 30*a* and 30*b* and the keepers 50*a* and 50*b* maintain the cover member 20 in its upright position, yet enable the latter member to be quick-releasably detached by simply pulling it away to release the magnetic attraction between the magnets and the keepers.

In operation, the seat and cover assembly 14 of the present invention is normally maintained in the normal closed, horizontal position as shown in FIG. 1. For use by a male in the standing position the assembly 14 is moved to the upright position of FIG. 2, whereby the cover member 20 is latched relative to the fixture 24 and the cover member and the seat member 16 and are biased to their abutting relationship by the action of the springs 48*a* and 48*b*. When used in the sitting position of FIG. 3, the user simply manually separates the seat member 16 from the cover member 20 with a force sufficient to overcome the spring tension of the springs 48*a* and 48*b*. The seat member is lowered to the horizontal position shown while the cover member is placed in its upright latched position. As soon as the user rises from the sitting position, the seat member 16 will move under the force of the springs 48*c* and 48*b* to its upright position in an abutting relationship with the upright cover member 20. Of course, the members 16 and 20 can then be moved to their lowered horizontal position shown in FIG. 1, by the user simply lowering the members 16 and 20 thus releasing the magnetic force between the magnets 30*a* and 30*b* and the keepers 50*a* and 50*b*, respectively.

Figure 3:
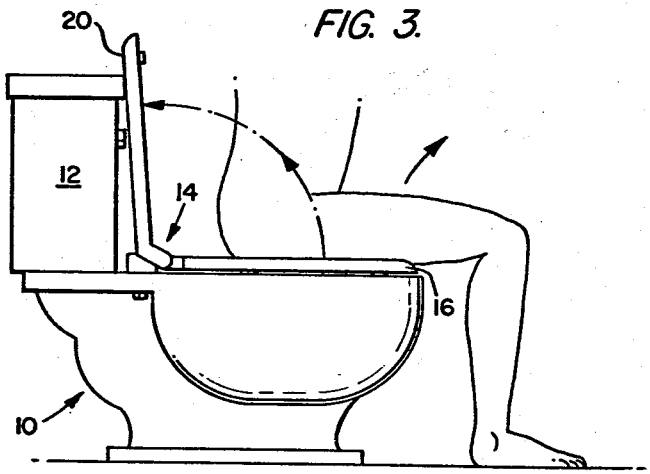
FIG. 3 is a view similar to FIG. 1 but depicting an operable position of the seat and cover assembly of the present invention.

It is thus seen that the seat and cover assembly of the present invention insures that there will be no soiling of the seat member during the standing position of a male since it is impossible for the seat member to rest in its lowered horizontal position while the cover member 20 is in its upright position unless the user is in the sitting position shown in FIG. 3.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A seat and cover assembly for a toilet bowl, said assembly comprising a seat member, a cover member for said seat member, means for mounting said seat member and said cover member relative to said bowl for pivotal movement between an upright position and a lowered position, spring means operatively engaging said seat member and said cover member for biasing said seat member towards said cover member and said cover member towards said seat member in all positions of said members, and means for quick-releasably securing said cover member in said upright position.

2. The assembly of claim 1 wherein said mounting means includes hinge means in a cooperative relation with said bowl, said seat member and said cover member.

3. The assembly of claim 2 wherein said mounting means includes a mounting block secured to said bowl and wherein said hinge includes at least one hinge pin extending in an opening in said mounting block.

4. The assembly of claim 1 or 3 wherein said spring means includes at least one torsion spring, one end of which is in engagement with said seat member and the other end of which is in engagement with said cover member.

5. The assembly of claim 4 wherein said torsion spring extends around said hinge pin.

6. The assembly of claim 4 wherein there are two hinge pins extending in corresponding openings in said mounting block and two torsion springs respectively extending around said hinge pins.

7. The assembly of claim 3 wherein said securing means comprises magnetic means extending between said mounting block and said cover member in the upright position of said cover member.

8. The assembly of claim 7 wherein said magnetic means comprises a pair of magnets mounted in said mounting block and adapted to magnetically engage said cover member in its upright position.

9. The assembly of claim 8 wherein upon release of said magnetic engagement, said members can be moved to said lowered position free of any of said bias.

* * * * *